United States Patent [19]

Homma et al.

[11] Patent Number: 4,852,793

[45] Date of Patent: Aug. 1, 1989

[54] SEALED CONTAINER AND PROCESS OF MANUFACTURE THEREOF

[75] Inventors: Yoshihiro Homma, Urawa; Akira Nakata, Ageo; Shiroh Matsumoto, Iwatsuki; Kunitoshi Yoshimura, Ohmiya; Masahiko Minato, Iwatsuki, all of Japan

[73] Assignee: Hokkai Can Co., Ltd., Tokyo, Japan

[21] Appl. No.: 190,064

[22] Filed: May 4, 1988

Related U.S. Application Data

[62] Division of Ser. No. 795,901, Nov. 7, 1985, Pat. No. 4,757,936.

[30] Foreign Application Priority Data

| | | | |
|---|---|---|---|
| Nov. 7, 1984 | [JP] | Japan | 59-167999 |
| Dec. 19, 1984 | [JP] | Japan | 59-266284 |
| Dec. 19, 1984 | [JP] | Japan | 59-266286 |

[51] Int. Cl.[4] ..... B65D 3/12; B65D 3/30

[52] U.S. Cl. ..... 229/5.5; 53/341; 53/478; 156/69; 220/73; 493/108; 493/133; 493/156

[58] Field of Search ..... 229/4.5, 5.5, 5.6, 5.7, 229/5.8, 199; 220/66, 67, 73; 156/69; 493/103–105, 108, 133, 135, 152, 156; 53/341, 344, 346, 478

[56] References Cited

U.S. PATENT DOCUMENTS

| | | | |
|---|---|---|---|
| 1,548,177 | 8/1925 | Strange | 229/5.7 |
| 2,122,044 | 6/1938 | Powell | 493/103 |
| 2,128,959 | 9/1938 | Nicholls | 229/5.5 |
| 2,252,854 | 8/1941 | Hubner et al. | 229/5.5 |
| 2,335,202 | 11/1943 | Wilcox | 229/5.5 |
| 2,354,532 | 7/1944 | Martin | 220/67 |
| 2,356,401 | 8/1944 | Hatch | 229/4.5 |
| 2,406,894 | 9/1946 | O'Brien | 229/5.5 |
| 2,413,449 | 12/1946 | Hatch | 156/69 |
| 3,912,154 | 10/1975 | Godar | 229/5.5 |
| 4,023,700 | 5/1977 | Buquet et al. | 220/67 |
| 4,346,832 | 8/1982 | Werner | 229/4.5 |
| 4,355,759 | 10/1982 | Amberg | 229/4.5 |
| 4,452,368 | 6/1984 | Roth | 220/67 |
| 4,471,900 | 9/1984 | Kadunce | 229/4.5 |
| 4,472,219 | 9/1984 | Taira et al. | 220/67 |
| 4,560,566 | 12/1985 | Roth | 156/69 |
| 4,757,936 | 7/1988 | Homma et al. | 229/5.5 |

FOREIGN PATENT DOCUMENTS

| | | | |
|---|---|---|---|
| 3322977 | 1/1985 | Fed. Rep. of Germany | 229/5.5 |
| 1337779 | 8/1963 | France . | |

*Primary Examiner*—Gary Elkins

*Attorney, Agent, or Firm*—Birch, Stewart, Kolasch & Birch

[57] ABSTRACT

A sealed container and method for manufacturing the same is disclosed in which the sealed container has a waterproof container barrel body made of paper and having opposing open ends, and a pair of closure members, one for each end, with each closure member cooperatively engageable with an end of the barrel body to form a hermetically sealed container. Each closure member includes a panel to generally cover each open end, a peripheral wall portion extending downward from the periphery of the panel and generally perpendicular thereto, a covering member is provided for covering an end surface of the container barrel body, and a reinforcing member adhered to a peripheral surface of an opening portion of the container barrel body. The peripheral wall portion of the closure member is mounted on the container barrel body and adhered thereto at a position corresponding to the adhered position of the reinforcing member.

13 Claims, 4 Drawing Sheets

SEALED CONTAINER AND PROCESS OF MANUFACTURE THEREOF

This application is a divisional of copending application Ser. No. 795,001, filed on Nov. 7, 1985, now U.S. Pat. No. 4,757,936 issued July 19, 1988.

BACKGROUND OF THE INVENTION

This invention relates to a sealed container using as a structural component a container barrel body made of paper. The sealed container is adapted to withstand internal pressure and is suitable for use as a sealed beverage container.

In recent years, from the standpoint of saving resources and the disposal of used containers, a large number of sealed containers have been used for containing fluid contents, such as a composite sealed can using a container barrel body made of paper as a structural component thereof. The sealed composite container of this type can be constructed as shown in FIG. 8, for example. As can be seen, a metallic closure a is hermetically attached to a container barrel body b made of paper by a double curling fastening similar to that used in a conventional metallic container barrel body in manufacturing canned beverages. In this case, the container barrel body made of paper lacks extensibility, unlike the metallic container barrel body, and accordingly when the same is subjected to the double curling fastening, a folded point d of a curling flange thereof and a compressed intermediate part thereof between a seaming wall part e and a chuck wall part f of the metallic closure member a are compressed to become stiff or weakened. When the internal gaseous pressure of the sealed container increases to a high level, the container barrel body made of paper is broken or ruptured at its folded point d and/or at its intermediate part. Consequently the metallic closure member sometimes comes off of the container barrel body.

SUMMARY OF THE INVENTION

A main purpose of this invention is to provide a sealed container which uses a container barrel body made of paper as a structural component and yet is sufficiently pressure proof so that it is possible to charge bubbling or sparkling type of beverages therein, such as a carbonated drink or the like.

An additional purpose of this invention is to provide sealed containers which can be packed in close contact with another one.

A further additional purpose of this invention is to provide a sealed container which can be incinerated for disposal.

For achieving the above main purpose, the closure member of this invention comprises a panel and a peripheral wall portion extending vertically downwards from the periphery of and generally perpendicular to the panel. An end surface of the container barrel body is covered with a covering member, and a peripheral surface of the opening portion of the container barrel body is provided with a reinforcing member adhered thereto. The peripheral wall portion of the closure member is mounted on the container barrel and is adhered thereto at a position corresponding to the adhered position of the reinforcing member.

For achieving the above additional purpose, the opening portion of the container barrel body is made smaller in its outer diameter than the remainder part thereof.

For achieving the above further additional purpose, the closure member and the covering member and reinforcing member are made of any material which can be incinerated.

BRIEF DESCRIPTION OF THE DRAWINGS

For a better understanding of the present invention, and to show how the same may be put into effect, reference will now be made, by way of example, to the accompanying drawings, in which.

DETAILED DESCRIPTION OF PREFERRED EMBODIMENTS

Embodiments of this invention will be explained in detail with reference to the attached drawing as follows.

Figure 1:
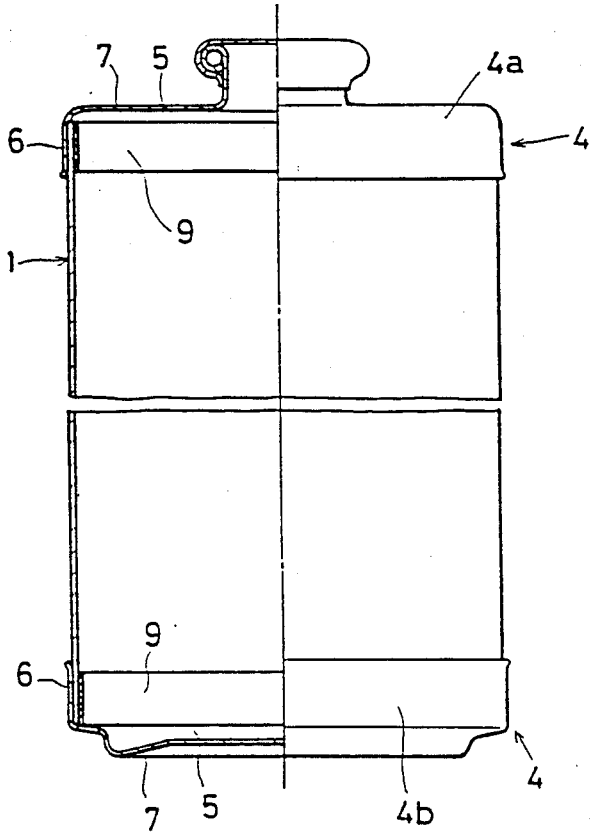
FIG. 1 is a partially sectional view of one embodiment of this invention.
Figure 2:
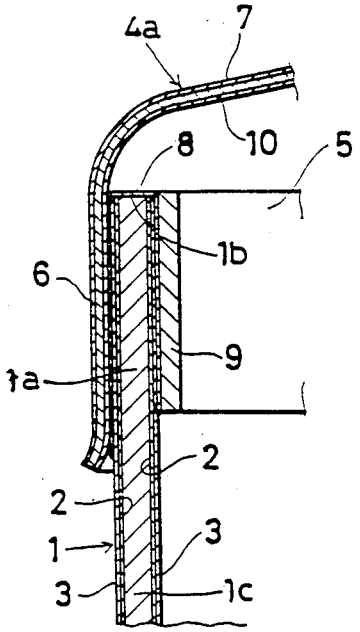
FIG. 2 is an enlarged view of a portion thereof.

Referring to FIG. 1 and FIG. 2 showing a first embodiment, a container barrel 1 is made of paper and can be a conventional composite container barrel body which may be of any desired construction, such as spiral, convolute, single wall, etc. The horizontal cross-sectional shape of the barrel body 1 may be any desired shape, such as a circle or a square. Inner and outer surfaces of the container barrel body 1 are applied with a waterproofing agent. As shown in FIG. 2 according to a conventional manner, a basic layer made of paper is applied, on both surfaces with a waterproof covering film formed by an aluminum foil 2 coated with a thermoplastic resin 3, comprising a metallic ion bridge polyolefin series resin (ionomer resin) or a polyolefin series resin including a polar group such as a carboxyl group or the like which has good heat adhering properties for adhering to a metallic material. A closure member 4 is made of a material which can be incinerated such as a material comprising an aluminum foil covered with synthetic resin. In the illustrated example, the container barrel body 1 is provided with two closure members 4, one of which is used as an upper closure member 4*a* having a pouring hole and the other of which is used as a lower closure member 4*b*. The respective constructions for joining the upper closure member 4*a* and the lower closure member 4*b* to the container barrel body 1 are the same.

Each of the upper and lower closure members 4*a* and 4*b* is formed into a cup-like cylinder which comprises a panel 7 and a peripheral wall portion 6 extending vertically downwards from the periphery of panel 7. Each of the closure members 4*a* and 4*b* is adaptable to be mounted at the peripheral wall portion thereof on an outer surface of an opening part 1*a* of the container barrel body 1. Accordingly, when a liquid beverage is contained in the resulting sealed container, an edge, that is, an end surface 1*b*, of the container barrel body 1 is exposed to the liquid. Therefore, according to this invention, a preventive means is taken such that each of the upper and lower end surfaces 1*b*, 1*b* of the container barrel body 1 is covered with a covering member 8 which can be a synthetic resin film.

An opening 5 of the container barrel body 1 is defined at both ends of the body. In addition, the peripheral wall portion 6 of each of the closure members 4*a* and 4*b* mounted on the peripheral outer surfaces of the upper and lower opening portions 1*a*, 1*a* of the container barrel body 1, is pressed against the peripheral outer surfaces of opening portions 1*a*, 1*a*. In addition, the peripheral wall portion 6 is adhered thereto under pressure so as to obtain a hermetically sealed container. In this case, the container barrel body 1 is made of paper, and sometimes cannot withstand the pressure and force when subjected to the pressing and adhering operations. According to this invention, as a preventive means, an annular reinforcing member 9 is provided, which is made of any material which can be incinerated, such as a polyethylene or the like. Annular reinforcing member 9 having a similar annular shape as the opening portion 1*a*, is adhered to an inner peripheral surface of the opening portion 1*a* of the container barrel body 1. Thus the peripheral wall portion 6 of each of the upper and lower closure members 4*a* and 4*b* is adhered to a part of the outer surface of the opening portion 1*a* that corresponds to the attached position of the reinforcing member 9. A covering film layer 10 is integrally provided on an inner surface of each of the upper and lower closure members 4*a* and 4*b*, and is made of a thermally fusible material such as the foregoing synthetic resin. The film layer 10 is used in adhering the peripheral wall portion 6 to the outer peripheral surface of the opening portion 1*a* of the container barrel body 1. Thus, because of the structure of the sealed container in accordance with the instant invention, when a carbonated beverage which will generate a high internal gaseous pressure is charged and hermetically enclosed therein, and even when an expansion force caused by the high internal gaseous pressure is applied to the container barrel body 1, there is no generation of any force for separating the joint portion between the inner surface of the peripheral wall portion 6 and the outer surface of the opening portion 1*a* of the container barrel body. Rather, a tightening force is generated on the joint portion between the opening portion 1*a* of the container barrel body 1 and the peripheral wall part 6, according to the diametrical contraction of the peripheral wall portion 6 of the expanded closure members 4*a* and 4*b* and the diametrical expansion of the opening portion 1*a* of the container barrel body 1. Thus the joint portion is no broken by the high gaseous pressure, resulting in an improved pressure proofing of the sealed container of this invention.

In the foregoing illustrated example, reinforcing member 9 is provided on the inner peripheral surface of the opening portion 1*a* of the container barrel body 1, but it can be modified such that the same is provided on the outer peripheral surface thereof.

A process for manufacturing the embodiment of FIGS. 1 and 2 is carried out as follows.

First, an end surface 1*b* of the opening portion 1*a* of the container barrel body 1 is covered with a covering member 8. Next, a reinforcing member 9 is adhered to a peripheral inner surface of the opening portion 1*a* of the container barrel body 1 through heat fusion by heating the covering member 8 and the coated resin 3. Thereafter, the closure member 4*a* (4*b*) is mounted on the outer surface of the opening portion 1*a* of the container barrel body 1. The peripheral wall portion 6 is adhered to the peripheral outer surface of the opening portion 1*a* at a part thereof corresponding to the adhered position of the reinforcing member 9.

Figure 3:
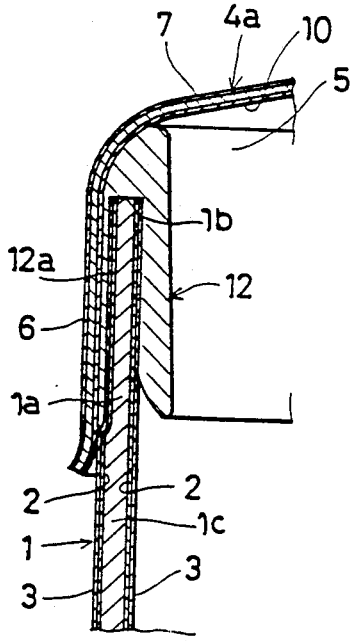
FIG. 3 is an enlarged view of a portion of a second embodiment of this invention similar to the view shown in FIG. 2.

FIG. 3 shows a sectional view of a second embodiment of this invention.

In this embodiment, the covering member 8 for waterproofing each of the upper and lower end surfaces 1*b*, 1*b* of the container barrel body 1 and the reinforcing member 9 for reinforcing the opening portion 1*b* are formed into a single unitary member 12, that is, a covering and reinforcing member 12. In the illustrated example, the member 12 is formed into U-shape for covering the outer peripheral surface, the end surface and the inner peripheral surface of the opening portion 1*a* of the container barrel body 1. Member 12 is mounted on an opening portion 1*a* compressed thinner so that an outer surface of an outer part 12*a* of the mounted member 12 is positioned parallel and level with an outer surface of the remainder portion 1*c*. Thus, the peripheral wall portion 6 of the closure member 4*a* or 4*b* mounted with member 12 on the container barrel body 1 and adhered thereto hardly protrudes from the outer surface of the remainder portion 1*c*.

Figure 4A:
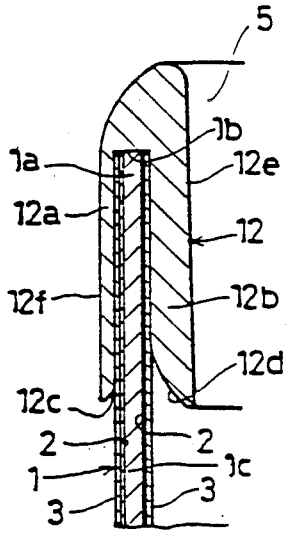
FIGS. 4(A)–4(D) are views for explaining a process of manufacturing the example of FIG. 3.
Figure 4B:
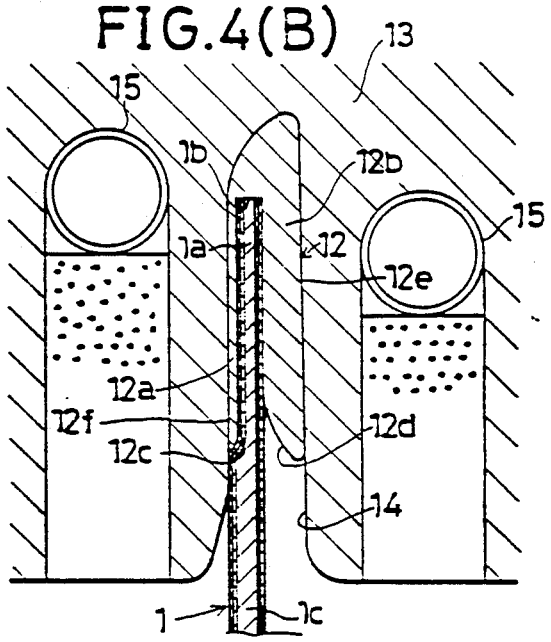

A process for manufacturing this second embodiment as shown in FIG. 3 is carried out, for example, as shown in FIGS. 4(A)–4(D). First, the U-shaped covering and reinforcing member 12 is mounted on the opening portion 1*a* of the container barrel body 1 as shown in FIG. 4(A). In order to facilitate this mounting operation, the covering and reinforcing member 12 is formed so that the lower ends of the two diverged outer portions 12*a* and inner portions 12*b* thereof are formed with guide surfaces 12*c* and 12*d*. Next, the opening portion 1*a* and the covering and reinforcing member 12 mounted on the opening portion 1*a* are pushed into an annular groove 14 made in a forming or pressing die 13. Groove 14 is formed so that the shape thereof conforms with the shape of the opening portion 1*a* and that the inner diameter of the groove 14 is the same as that of the inner diameter of the innermost surface 12*e* of the covering and reinforcing member 12 and that the outer diameter of the groove 1 is the same as that of the outer diameter of the container barrel body 1. The forming die 13 is provided with a pair of heating means 15. By the foregoing pushing of the covering and reinforcing member 12 together with the opening portion 1*a* of the container barrel body 1 into the groove 14 of the forming die 13, the portion 12*b* of the covering and reinforcing member 12 is immovably held from the inside by the inside part of the die 13 and at the same time the outer portion 12*a* of the covering and reinforcing member 12 and the opening portion 1*a* are pressed inward. The opening portion 1*a* is compressed to become thinner and the outer portion 12*a* is nestled in a recessed space or room formed outside the compressed thinner opening portion 1*a* of the container barrel body 1. Thus, an outer surface of the outer portion 12*a* is positioned parallel and level with the outer surface of the remainder portion 1*c* of the container barrel body 1. Under this condition the member 12 and the opening portion 1*a* are adhered together by the two heating means 15, as shown in FIG. 4(B).

Figure 4C:
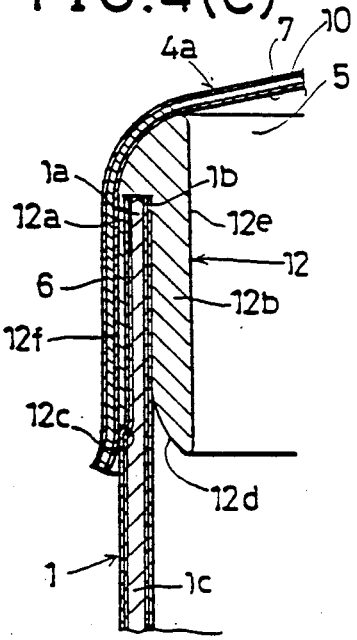
Figure 4D:
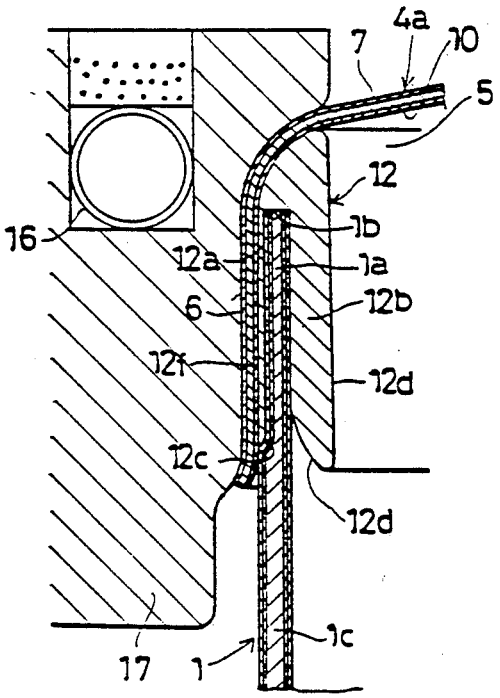

Thereafter, as shown in FIG. 4(C), the peripheral wall portion 6 of closure member 4*a* (4*b*) is mounted, through the outer portion 12*a*, on the outer surface of the opening portion 1*a* of the container barrel body 1. As shown in FIG. 4(D), the peripheral wall portion 6 of the closure member 4*a* (4*b*) is then pressed against the outer portion to be adhered thereto by a pressure application die 17 provided with a heating means 16 applied under pressure to the outer surface of the peripheral wall portion 6.

Figure 5:
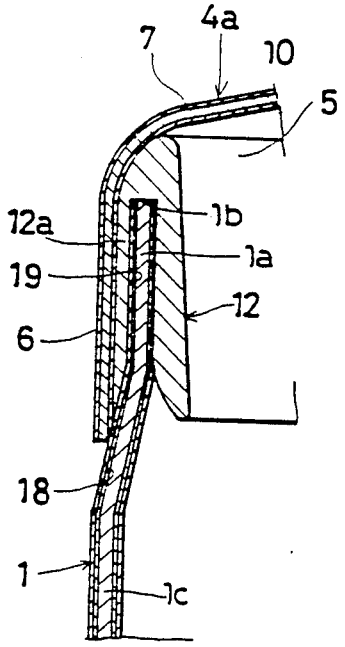
FIG. 5 is an enlarged view of a portion of a third embodiment of this invention similar to the view shown in FIG. 2.

FIG. 5 shows a sectional view of a third embodiment in which the opening portion 1*a* of the container barrel body 1 is formed into a reduced-diameter portion 19 and a necked-in portion 18 connecting the reduced-diameter portion 19 and the remainder portion 1*c*. The outer portion 12*a* of the covering and reinforcing member 12 is placed on the reduced-diameter portion 19 so that the outer surface of the peripheral wall portion 6 is positioned parallel and level with the outer surface of the remainder portion 1*c* of the container barrel body 1.

A process of manufacturing the third embodiment of the sealed container, is carried out as shown in FIGS. 6(A)–6(D).

Figure 6A:
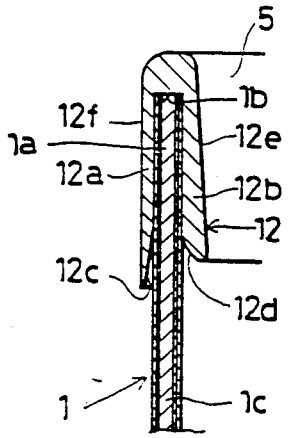
FIGS. 6(A)–6(D) are views for explaining a process of manufacturing the example in FIG. 5.
Figure 6B:
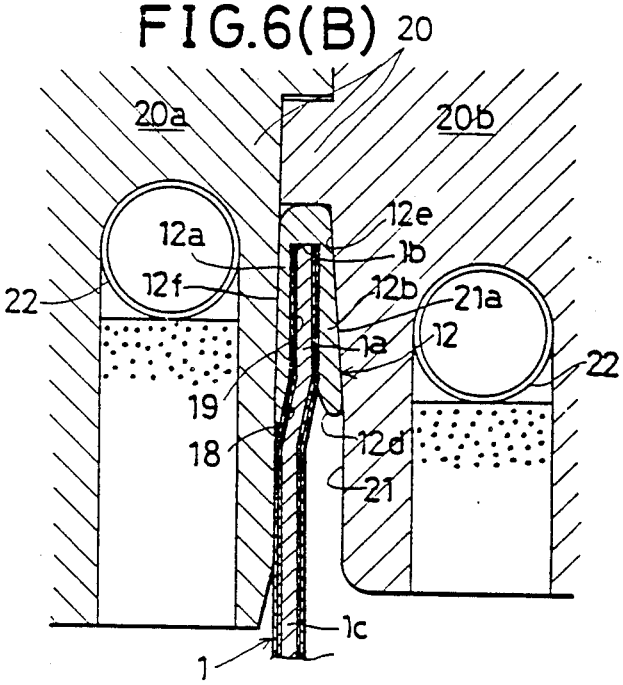

As shown in FIG. 6(A), first, the covering and reinforcing member 12 is mounted on the opening portion 1*a* of the container barrel body 1. In order to facilitate the foregoing mounting operation,the covering and reinforcing member 12 is arranged so that the lower ends of two lower end parts thereof are provided with the guide surfaces 12*c* and 12*d* in the same manner as in FIG. 4. The outermost surface 12*f* of the covering and reinforcing member 12 is a vertical surface, while the innermost surface 12*e* thereof is a slant surface that is directed inward from the upper end thereof to the lower end. Thus, the innermost diameter of the member 12 becomes smaller towards the lower end thereof. In other words, the thickness of the inner portion 12*b* of the member 12 becomes thicker towards the lower end thereof. Next, as shown in FIG. 6(B), a drawn forming of the container barrel body 1 is carried out by using a forming die 20 having an annular groove 21 having a sectional shape formed to conform with the sectional shape of the covering and reinforcing member 12. An outer diameter of the annular groove 21 is the same as that of the container barrel body 1. The forming die 21 comprises two split molds 20*a* and 20*b* provided with respective heating means 22. The covering and reinforcing member 12 mounted on the opening portion 1*a* of container barrel body 1 is pushed into the groove 21 of the forming die 20 so that the opening portion 1*a* of the container barrel body 1 and the outer portion 12*a* of the covering and reinforcing member 12 may be pressed inward to form a reduced-diameter covering and reinforcing member and a reduced-diameter opening portion 1*a*. A necked-in portion 18 is produced due to the guide of the slant innermost surface 12*e* of member 12 and a slant surface 21*a* of groove 21. Under this condition, the covering and reinforcing member 12 and the opening portion 1*a* of the container barrel body 1 are heated by the heating means 22, 22 and thus adhered together through heat fusion of the coated resin 3.

Figure 6C:
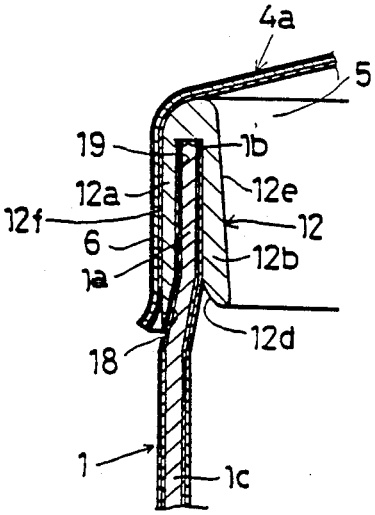
Figure 6D:
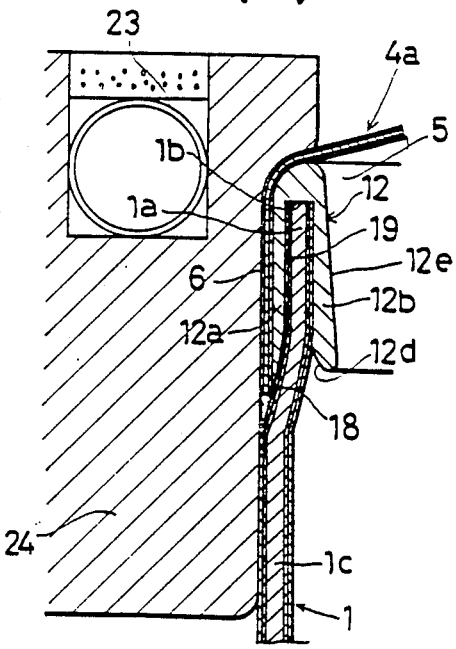

Thereafter, as shown in FIG. 6(C), the peripheral wall portion 6 of the closure member 4*a* (4*b*) is mounted, by way of member 12, on the reduced-diameter portion 1*a* of the container barrel body 1. As shown in FIG. 6(D), a pressure application die 24 provided with a heating means 23 is brought into pressure contact with the peripheral wall portion 6 of the closure member 4*a* (4*b*). Under this condition, the peripheral wall portion 6 is heated to adhere to member 12 through heat fusion of the coated resin 10, that is, wall portion 6 is thus adhered to portion 1*a* of the container barrel body 1.

In each of the foregoing embodiments in FIG. 3 and FIG. 5, the end surface 1*b* of the opening portion 1*a* of the container barrel body 1 can be protected from the liquid contents of the sealed container by the covering and reinforcing member 12. Consequently, weakening of the container barrel body 1 caused by penetration of the liquid contents through the end surface 1*b* thereof can be prevented. In addition, in a case where the sealed container contains a bubbling beverage such as a carbonated drink which generates a high pressure, even when an expansion force of the internal high gaseous pressure is applied to the container barrel body 1 thereof, there is no generation of any force for separating the joint portion between the inner surface of the peripheral wall portion 6 and the outer surface of the opening portion 1*a* of the container barrel body 1. On the contrary, a tightening force is generated and applied to the joint portion between the opening portion 1*a* of the container barrel body 1 and the peripheral wall portion 6 of the closure members 4*a* and 4*b*. This tightening force occurs due to contraction of the peripheral wall portion 6 of the expanded closure member 4*a* (4*b*) and the diametrical expansion of the opening portion 1*a* of the container barrel body 1. Thus, the joint portion is not broken by the high gaseous pressure, thus resulting in improved pressure proofing of the sealed container.

Furthermore, since the outer portion 12*a* of the covering and reinforcing member 12 is provided on the outer surface of the reduced outer diametrical opening portion 1*a* of the container barrel body 1, the peripheral wall portion 6 of the closure member 4*a* (4*b*) does not substantially protrude beyond the outer surface of the container barrel body 1. Consequently, plural sealed containers of this invention can be stacked in substantially close contact with one another.

In the foregoing embodiments in FIG. 3 and FIG. 5, there has been adopted the U-shaped covering and reinforcing member 12 for covering the outer surface, the end surface and the inner surface of the opening portion 1*a*. However, as can be seen the example in FIG. 1 and FIG. 2, it is sufficient that the same covers the end surface and the inner surface alone or the outer surface alone of the opening portion 1*a*.

Figure 7:
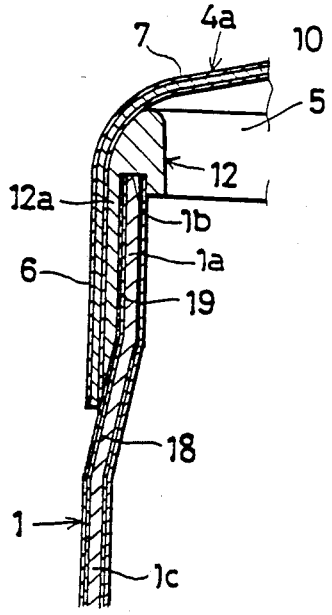
FIG. 7 is an enlarged view of a portion of a modified example of the embodiment of FIG. 5 similar to the view shown in FIG. 2.
Figure 8:
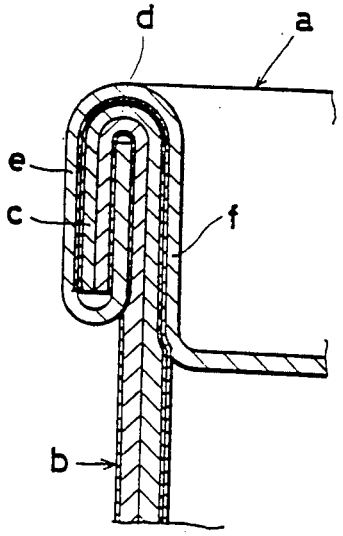
FIG. 8 is an enlarged sectional view of a portion of a conventional example.

A modified embodiment of such a type is shown in FIG. 7. Namely, the covering and reinforcing member 12 is formed into an L-shape, for covering the end surface and the outer surface alone of the opening portion 1*a* of the container barrel body 1. The other structural arrangements are the same as the embodiment of FIG. 5. In the foregoing embodiments, the container barrel body 1, the closure member 4*a* (4*b*) and the covering and reinforcing member 12 are all made of any material which can be incinerated, so that after use of this invention, the same can be disposed of, simply by incineration. Even if, the closure member 4*a* (4*b*) is made of a metallic material such as aluminum, tin free steel, tinplated sheet or the like used for making a sealed container for a carbonated beverage, the container after use, can still be disposed of by incineration.

It is readily apparent that the above-described meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A sealed container, comprising:

a waterproof container barrel body made of paper and having opposing opposite ends; and a pair of closure members, one for each end, each cooperatively engageable with an end of the barrel body to form a hermetically sealed container, each closure member including, a panel to generally cover each open end, a peripheral wall portion extending downward from the periphery of said panel and generally perpendicular thereto, a covering means for covering an end surface of said container barrel body, and a reinforcing member adhered to a peripheral surface of each of the opposing open ends of the container barrel body, the peripheral wall portion of the closure member being mounted on the container barrel body and adhered thereto at a position corresponding to the adhered position of said reinforcing member, said reinforcing member withstanding pressure and force applied thereto when the closure member is positioned on said container barrel body;

said covering means and said reinforcing member are an integral covering and reinforcing member and the covering and reinforcing member is an L-shaped element for covering the end surface and only one surface of the opening portion of the container barrel body.

2. The sealed container of claim 1, wherein said reinforcing member is made of thermoplastic synthetic resin.

3. The sealed container according to claim 1, wherein the covering and reinforcing member is made of any material which can be incinerated.

4. The sealed container of claim 1, wherein the container barrel body has a wall type selected from the group consisting of a spiral, convolute, or single wall type.

5. The sealed container of claim 1, wherein the closure member is made of any material selected from the group consisting of aluminum, tin-free steel, tin-plated steel and a lamination of a synthetic resin film and a metallic foil made of aluminum or tin-free steel.

6. The sealed container of claim 1, wherein the opening portion of the container barrel body is made smaller in its outer diameter than a remainder portion thereof.

7. The sealed container of claim 1 wherein the opening portion of the container barrel body is formed with a necked-in region and a diametrically reduced region formed adjacent to the necked-in region at the end of the container barrel body, and said reinforcing member is provided on an outer surface of the reduced region of the opening portion such that an outer surface of the peripheral wall portion of the closure member, mounted on the reinforcing member disposed on the outer surface of the opening portion of the container barrel body, is positioned to be generally even with an outer surface of a remainder portion of the container barrel body.

8. The sealed container claim 7, wherein said reinforcing member is an outer part of a covering and reinforcing member for covering the end surface and at least the outer surface of the opening portion of the container barrel body.

9. A sealed container comprising:

a waterproof container barrel body made of paper and having opposite open ends; and a pair of closure members, one for each end, each cooperatively engageable with an end of the barrel body to form a hermetically sealed container, each closure member including, a panel to generally cover each open end, a peripheral wall portion extending downward from the periphery of said panel and generally perpendicular thereto, a covering means for covering an end surface of said container barrel body, and a reinforcing member adhered to a peripheral surface of each of the opposing open ends of the container barrel body, the peripheral wall portion of the closure member being mounted on the container barrel body and adhered thereto at a position corresponding to the adhered position of said reinforcing member, said reinforcing member withstanding pressure and force applied thereto when the closure member is positioned on said container barrel body;

said covering means and said reinforcing member are an integral covering and reinforcing member and the covering and reinforcing member is an L-shaped element for covering the end surface and only the outer surface of the opening portion of the container barrel body.

10. The sealed container according to claim 9, wherein the covering and reinforcing member is made of any material which can be incinerated.

11. A method of manufacturing a sealed container of the type in which an opening portion of a waterproof container barrel body made of paper is hermetically sealed with a closure member, comprising the steps of:

mounting on a periphery of said opening portion of said container barrel body a U-shaped covering and reinforcing member for covering an outer surface, an end surface, and an inner surface of said opening portion of the container barrel body;

pressing an outer surface of an outer part of the covering and reinforcing member while holding an inner part of the covering and reinforcing member immobile from the inside of the container barrel body such that the opening portion is formed into a compressed thinner opening portion, and the outer part of the covering and reinforcing member is nestled in a recessed space formed outside the compressed thinner opening portion thereof, and simultaneously heating the covering and reinforcing member to adhere to the peripheral surface of the opening portion of the container barrel body;

mounting a closure member, having a panel and a peripheral wall portion extending downward from the periphery of and generally perpendicular to said panel, by way of the covering and reinforcing member, on the opening portion of the container barrel body; and adhering the peripheral wall portion of the closure member, by way of the covering and reinforcing member, to the opening portion of the container barrel body.

12. A method of manufacturing a sealed container of the type in which an opening portion of a waterproof container barrel body made of paper is hermetically sealed with a closure member, comprising the steps of:

mounting on a periphery of said opening portion of the container barrel body an L-shaped covering and reinforcing member for covering and end surface and an outer surface of said opening portion of the container barrel body;

pressing an outer surface of an outer part of the covering and reinforcing member while holding an inner part of the covering and reinforcing member immobile from the inside of the container barrel body such that the opening portion is formed into a compressed smaller opening portion, and the outer part of the covering and reinforcing member is located on a peripheral outer surface of said compressed smaller opening portion, and simultaneously heating the covering and reinforcing member to adhere to said peripheral outer surface of said smaller opening portion of the container barrel body;

mounting a closure member, having a panel and a peripheral wall portion extending downward from the periphery of and generally perpendicular to said panel, by way of the covering and reinforcing member, on the opening portion of the container barrel body; and adhering the peripheral wall portion of the closure member, by way of the covering and reinforcing member, to the opening portion of the container barrel body.

13. A method of manufacturing a sealed container of the type in which an opening portion of a waterproof container barrel body made of paper is hermetically sealed with a closure member, comprising the steps of:

mounting on a periphery of said opening portion of the container barrel body an L-shaped covering and reinforcing member for covering an end surface and an outer surface of said opening portion of the container barrel body;

pressing inwardly the periphery of the opening portion of the container barrel body together with the mounted covering and reinforcing member by pushing the mounted covering and reinforcing member into an annular groove of a forming die that is smaller in its diameter than an outer diameter of the container barrel body so that the opening portion of the container barrel body together with the mounted covering and reinforcing member may be so bent inwardly as to be formed into a diametrically reduced opening portion provided with a necked-in part, with the covering and reinforcing member being diametrically reduced, and simultaneously heating the covering and reinforcing member to adhere to the peripheral surface of the opening portion of the container barrel body;

mounting a closure member, having a panel and a peripheral wall portion extending downward from the periphery of and generally perpendicular to said panel, by way of the diametrically reduced covering and reinforcing member, on the opening portion of the container barrel body such that an outer surface of the peripheral wall portion of the closure member is positioned generally even with a remainder portion of the outer surface of the container barrel body; and adhering the peripheral wall portion of the closure member, by way of the covering and reinforcing member, to the opening portion of the container barrel body.

* * * * *